US006434923B2

(12) United States Patent
Stahlecker

(10) Patent No.: US 6,434,923 B2
(45) Date of Patent: Aug. 20, 2002

(54) TOP ROLLER UNIT FOR A DRAFTING APPARATUS OF A SPINNING MACHINE

(75) Inventor: Hans Stahlecker, Donzdorf (DE)

(73) Assignee: Wilhelm Stanlecker GmbH, Deggingen-Reichenbach i.T. (DE)

( * ) Notice: Subject to any disclaimer, the term of this patent is extended or adjusted under 35 U.S.C. 154(b) by 0 days.

(21) Appl. No.: 09/815,249

(22) Filed: Mar. 23, 2001

(30) Foreign Application Priority Data

Apr. 4, 2000 (DE) ..... 100 16 655

(51) Int. Cl.[7] ..... D01H 13/04

(52) U.S. Cl. ..... 57/315; 57/328; 19/150; 19/246

(58) Field of Search ..... 57/264, 304, 315, 57/328, 333; 19/150, 236–250, 252, 263, 286, 287, 288, 304–308

(56) References Cited

U.S. PATENT DOCUMENTS 6,082,089 A * 7/2000 Stahlecker ..... 57/315
6,108,873 A * 8/2000 Barauke ..... 19/236
6,161,258 A * 12/2000 Stahlecker ..... 19/286
6,185,790 B1 * 2/2001 Stahlecker ..... 19/246
6,209,303 B1 * 4/2001 Stahlecker ..... 57/304
6,237,317 B1 * 5/2001 Stahlecker ..... 57/315

OTHER PUBLICATIONS

Brochure entitled "SUESSEN Elite Spinning System", NR. SLP.0001 NE 04.99, pp. 1–24.

* cited by examiner

*Primary Examiner*—Danny Worrell
*Assistant Examiner*—Gary L. Welch
(74) *Attorney, Agent, or Firm*—Crowell & Moring LLP

(57) ABSTRACT

A top roller unit is arranged on a top weighting arm for a drafting apparatus of a spinning machine, which top roller unit has a holding device and two double top rollers and is arranged at two adjacent spinning stations. A first top roller of a spinning station borders a drafting zone which serves to draft a fiber strand, and a second top roller of a spinning station borders a condensing zone which serves to condense the fiber strand and which is arranged downstream of the drafting zone. The second top roller of each spinning station is driven via a drive by the first top roller, which drive takes the form of an intermediate gear which is common to all the top rollers of the top roller unit. The top roller unit is supported by a housing which encapsulates the intermediate gear.

35 Claims, 3 Drawing Sheets

TOP ROLLER UNIT FOR A DRAFTING APPARATUS OF A SPINNING MACHINE

BACKGROUND AND SUMMARY OF THE INVENTION

This application claims the priority of German Patent Document 100 16 655.5, filed in Germany, Apr. 4, 2000, the disclosure of which is expressly incorporated by reference herein.

The present invention relates to a top roller unit which can be arranged on a top weighting arm for a drafting apparatus of a spinning machine, which top roller unit comprises a holding device and two double top rollers, which in turn each comprise two top rollers arranged on a common axle, thus each being arranged at two adjacent spinning stations, whereby, in transport direction of fiber strands which run through the spinning stations, the first top roller of a spinning station borders a drafting zone which serves to draft the fiber strand, and the second top roller of this spinning station borders a condensing zone serving to condense the fiber strand, which condensing zone is arranged downstream of the drafting zone, and whereby the second top roller of each spinning station is driven via drive means by the first top roller.

A top roller unit of this type is prior art in the brochure "SUESSEN Elite Spinning System", Nr. SLP.0001 NE 04.99. In this brochure, the known top roller unit is designated as an "E-Top" and comprises double top rollers, which take the form of so-called idle rollers, that is, they comprise stationary, non-rotating axles on which the top rollers, rotatable independently from one another, are supported. Consequently, the second top roller of each spinning station in transport direction must be driven independently of the second top roller of the other spinning station. In the case of the known top roller unit, each of the two spinning stations has an intermediate gear of its own comprising the drive means arranged thereat. Each of the two intermediate gears comprises three toothed wheels.

It is an object of the present invention to simplify the drive means and in addition to design them as compactly as possible, so that the drive means can be shielded in a simple way against fiber fly.

This object has been achieved in accordance with the present invention in that the drive means takes the form of an intermediate gear common to all the top rollers of the top roller unit and in that both double top rollers take the form of so-called fixed rollers fixedly arranged on rotatable axles.

The simplification of the drive means according to the present invention is made possible in that the double top rollers are arranged anyway at two adjacent spinning stations and are influenced by each other. The simplification of the drive means also means, however, that so-called idle rollers are now no longer possible, and that rather the top rollers arranged on a common axle now rotate together with this axle.

Due to the compact construction, protection against fiber fly is additionally possible in that the holding device takes the form of a housing which encapsulates the intermediate gear, and through which housing the axles of the double top rollers are inserted in a sealed way. The joint intermediate gear is placed for the purpose in the center of the double top rollers.

For reasons of simple assembly and dismantling, the housing can comprise two housing sections which can be swivelled towards one another. If the partition is hereby disposed in the plane defined by the axles, then a clamping of the tubes supporting the axles is possible during assembly.

In one variation of the present invention, the intermediate gear can comprise a toothed belt drive. Thus large distances between the double top rollers can be bridged in a simple way. In another embodiment, the intermediate gear can comprise three toothed wheels, of which one toothed wheel each is arranged on the axles of the double top rollers and the third toothed wheel takes the form of a transfer wheel bridging the distance between the two other toothed wheels. In the case of such an embodiment it is superfluous to provide a tension device as is often necessary with toothed belt drives.

In a further embodiment of the present invention it is provided that the first top roller twin of the top roller unit in transport direction of the fiber strands is nested in a spring mounted take-up of the top weighting arm. In this way, the top roller unit can be arranged on the top weighting arm as is usual in the case of front top rollers of drafting apparatus. The second top roller twin is then swivelable, together with the housing, around the axle of the first top roller twin. The spring mounted take-up can hereby comprise the loading spring for the first top roller twin. By means thereof, that top roller twin in paticular is loaded which—as a part of the front roller pair of the drafting apparatus—requires a high loading force.

Basically, the same one loading spring could also load the second top roller twin which borders the condensing zone. It is more practical, according to certain preferred embodiments of the invention, however, when a loading spring of its own, arranged on the top weighting arm, is placed to the second top roller twin in transport direction of the fiber strands. In this way, the desired slight pressure of the second top roller twin against a nipping surface is achieved.

Other objects, advantages and novel features of the present invention will become apparent from the following detailed description of the invention when considered in conjunction with the accompanying drawings.

DETAILED DESCRIPTION OF THE DRAWINGS

Figure 1:
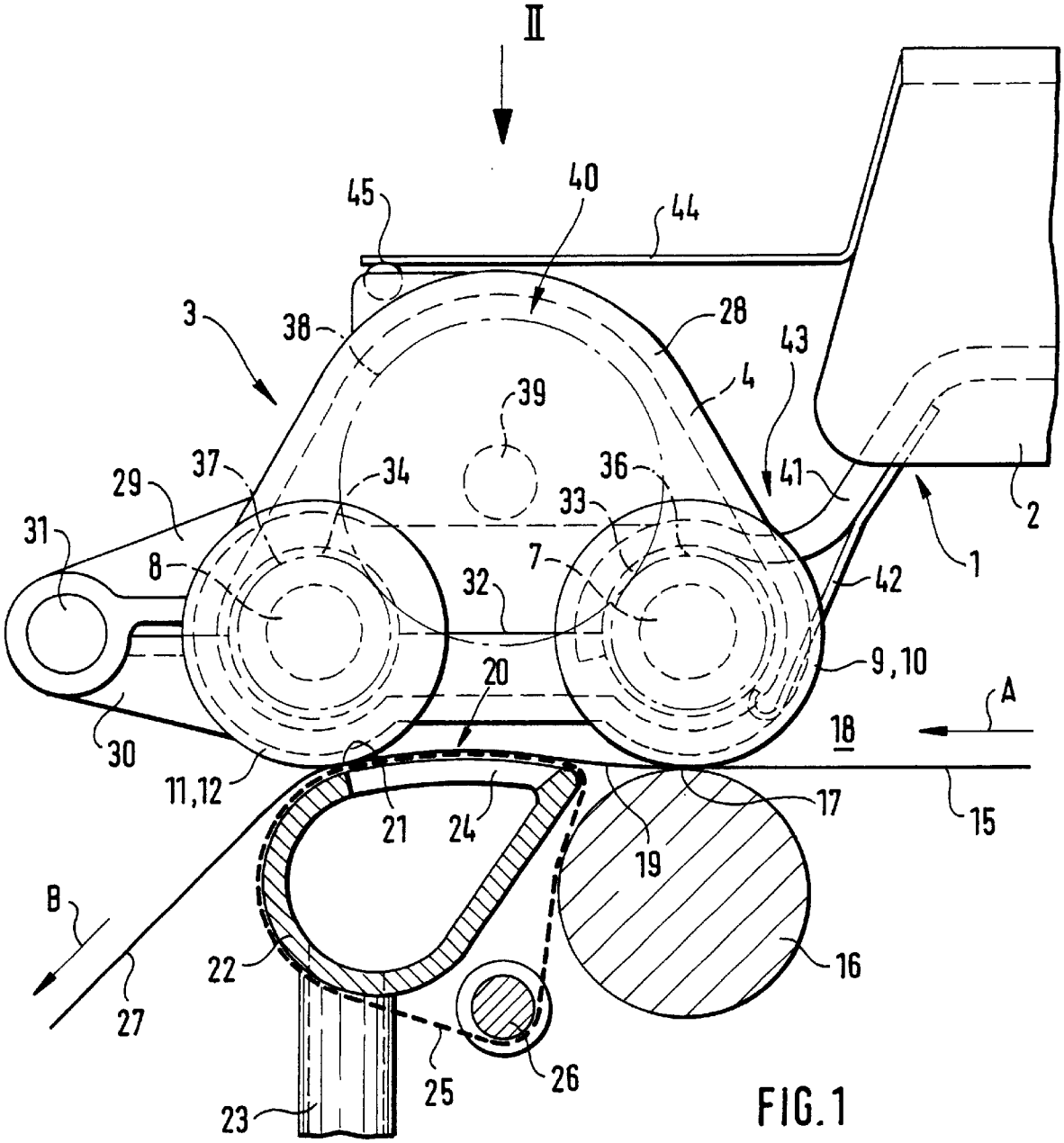
FIG. 1 is a partly sectional side view of a top roller unit constructed according to a preferred embodiment of the present invention.
Figure 2:
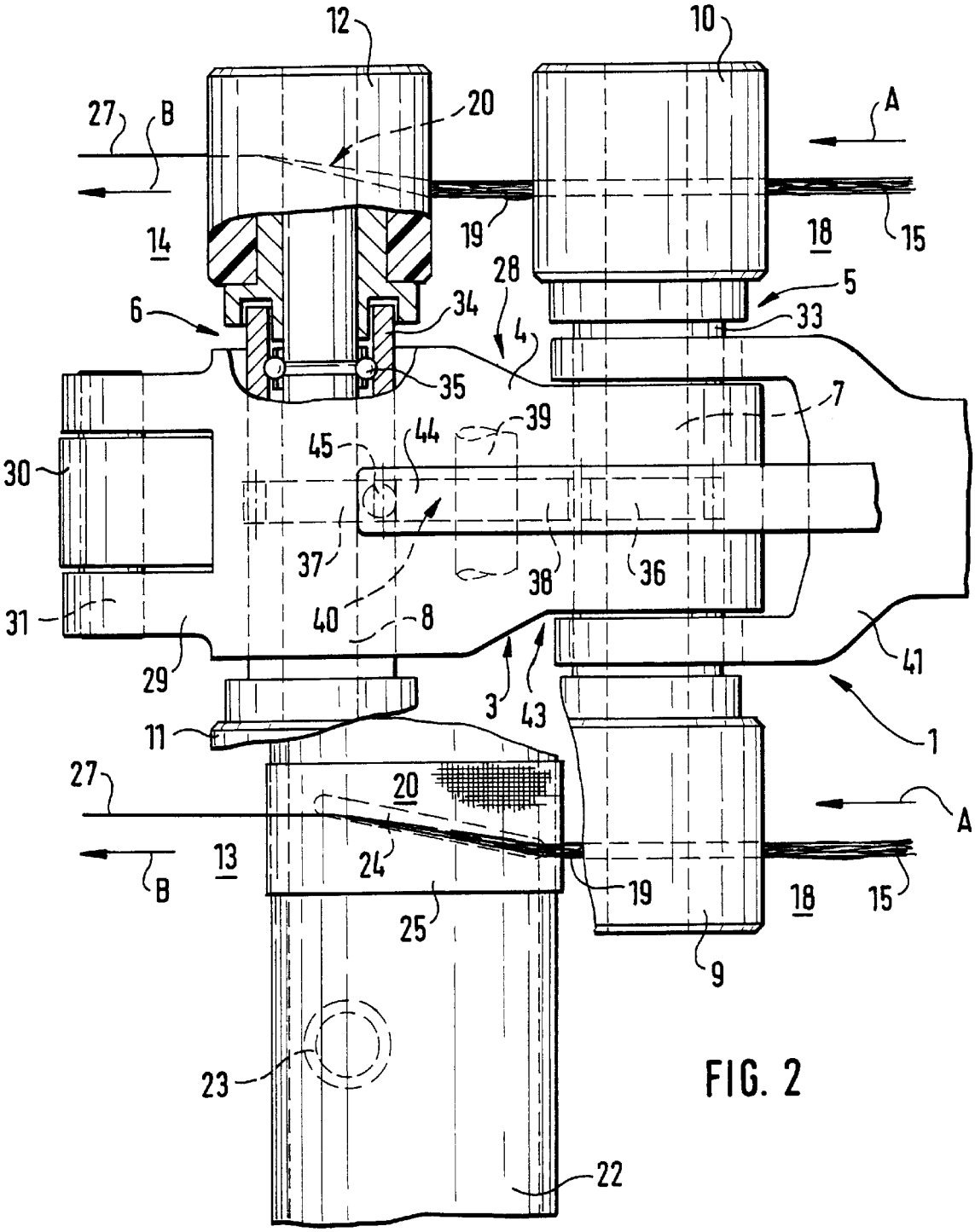
FIG. 2 is a view in the direction of the arrow II of FIG. 1 onto the top roller unit according to the present invention, whereby for reasons of simplicity the front bottom cylinder of the drafting apparatus as well as several other secondary components have been omitted.

In FIGS. 1 and 2, only the end area of a drafting apparatus 1 is shown of a spinning machine, in particular a ring spinning machine. The end part of a top weighting arm 2 belonging to the drafting apparatus 1 can be seen, on which top weighting arm 2 the top roller unit 3 according to the present invention is arranged and which is described in more detail below. The top roller unit 3 comprises two double top rollers 5 and 6 as well as a holding device 4 which supports the double top rollers 5 and 6.

Each of the two double top rollers 5 and 6 comprise a common axle 7 or 8 for two top rollers 9 and 10 or 11 and 12 arranged thereon. The axles 7 and 8 are rotatably supported, the top rollers arranged thereon rotate together with their axles 7 or 8. In this case, these are so-called fixed rollers, as the top rollers 9, 10, 11 and 12 are connected fixedly to the axles 7 and 8. Each of the double top rollers 5 and 6 is arranged thus for two adjacent spinning stations 13 and 14, so that each top roller unit 3 is arranged at two adjacent spinning stations 13 and 14.

A plurality of spinning stations and thus top roller units are arranged in a machine longitudinal direction.

In each spinning station 13, 14, a fiber strand 15 is guided through the drafting apparatus 1 in transport direction A and drafted hereby to the desired degree of fineness.

The drafting apparatus 1 is bordered in transport direction A by a front roller pair, which also comprises, in addition to the above mentioned top roller 9 or 10, a driven bottom cylinder 16 extending in machine longitudinal direction. The bottom cylinder 16 is thus arranged together with the top roller 9 at the spinning station 13, but is arranged together with the top roller 10 however at the spinning station 14. With regard to the respective top roller unit 3, the top rollers 9 and 10 form in transport direction A the so-called first top roller. Accordingly, the top rollers 11 and 12 downstream thereof are denoted as the second top rollers.

The drafting zone 18 of the drafting apparatus 1 ends at the front nipping line 17 formed by the front roller pair. Directly downstream of the front nipping line 17 lies a drafted, but still twist-free fiber strand 19, to which the actual spinning twist must subsequently be imparted.

When the spinning twist is imparted to the drafted fiber strand 19 directly downstream of the front nipping line 17, as is known, a so-called spinning triangle occurs, whose form exerts a deciding influence on the structure of the arising thread 27. Those fibers of the spinning triangle which are disposed more to the outside are often insufficiently embedded in the arising thread 27, so that they are lost partly as fiber fly, or at least give a hairy appearance to the arising thread 27. In addition, these edge fibers contribute little to the tensile strength of the thread 27. In order to eliminate this disadvantageous spinning triangle and thus to make the yarn less hairy and more tear resistant, a so-called condensing zone 20 has in recent times been arranged downstream of the drafting zone 18, the spinning twist being applied to the arising thread 27 only after it has passed through this condensing zone 20. In the condensing zone 20, the drafted, but still twist-free fiber strand 19 is laterally bundled, so that it does not form a spinning triangle after it has passed through a delivery nipping line 21 bordering the condensing zone 20 in transport direction A. The delivery nipping line 21 acts as a twist block against the spinning twist. Downstream of the delivery nipping line 21, the arising thread 27 is fed in delivery direction B to a twist device, for example a ring spindle, which imparts the necessary spinning twist to the thread 27.

The delivery nipping line 21 occurs by pressing each of the second top rollers 11 or 12 against a stationary suction channel 22, which takes the form of a hollow profile prevailing internal vacuum, and which extends over a plurality of spinning stations, for example over one machine section. Thus a plurality of suction channels 22 are arranged adjacently in machine longitudinal direction. Each suction channel 22 is connected to a vacuum source (not shown) by a vacuum conduit 23.

The suction channel 22 comprises per spinning station 13, 14 a suction slit 24 extending essentially in transport direction A, the suction slit 24 being disposed slightly diagonally to the transport direction A. In the area of the respective suction slits 24, the outer contour of the suction channel 22 is in the form of a sliding surface for a circulating, air-permeable transport belt 25. For the purpose of the present invention, the air permeability is generated in that the transport belt 25 takes the form of a thin, finely-meshed woven belt. The transport belt 25 transports the fiber strand 19 to be condensed through the condensing zone 20 and slides hereby on the suction channel 22, with the exception of an area facing away from the suction slit 24, where the transport belt 25 is tensioned by a tension element 26 and guided laterally. The circulating transport belt 25 comes into contact with the counter-rotating driven bottom cylinder 16, so that the transport belt 25 is cleaned of any adhering fiber fly.

The holding device 4 supporting the double top rollers 5 and 6 takes the form of a closed housing 28, which is penetrated by the axles 7 and 8 in a sealed way. This protects the inside of the housing 28, for reasons to be described below, from fiber fly. The housing 28 consists for the purpose of the invention of two section housings 29 and 30, which are connected with one another by a swivel axle 31. The partition line 32 is defined in the area of a plane through the axles 7 and 8, so that stationary tubes 33 and 34 supporting the axles 7 and 8 can be clamped in between the two section housings 29 and 30. This operational state of the housing 28 can be secured by a screw connection (not shown).

The rotatable axles 7 and 8 of the double top rollers 5 and 6 are supported by means of bearings 35 in the stationary tubes 33 and 34. The double top rollers 5 and 6 are in this way in the form of so-called fixed rollers.

In the center of each axle 7 and 8, a toothed wheel 36 or 37 is located inside the housing 28, which is denoted only by a dot-dash reference circle. These toothed wheels 36 and 37 form, together with a third toothed wheel 38, the so-called transfer wheel which bridges the distance between them, the drive for all four top rollers 9, 10, 11 and 12. The toothed wheel 38 is hereby freely rotatable around an axle 39 supported in the section housing 29.

The toothed wheels 36, 37 and 38 are the main components of an intermediate gear 40, by means of which the peripheral speed of the first top rollers 9 and 10 is transferable to the second top rollers 11 and 12, with possibly a slight tension draft for the strands 19. Because the axles 7 and 8 penetrate the housing 28 in a sealed way, the intermediate gear 40 is sealed against fiber fly, so that the toothed wheels 36, 37 and 38 are not impaired by fiber fly.

A strong loading spring 41 is arranged at the top weighting arm 2, which loading spring 41, together with an additional nipping spring 42, forms a resilient take-up 43 for the axle 7 of the first top roller twin 5. This occurs by means of clamping the stationary tube 33 in which the axle 7 is rotatably supported. The loading spring 41 transfers at the same time the loading pressure onto the first top rollers 9 and 10, which form the front top rollers of each respective drafting unit 1.

As the respective second top rollers 11 and 12 of each spinning station 13, 14 need only be loaded with significantly less pressure, a further loading spring 44 is applied to the top weighting arm 2, which spring 44 presses with less force against a supporting surface 45 of the housing 28 and thus essentially loads the second double top roller 6 in transport direction A.

Figure 3:
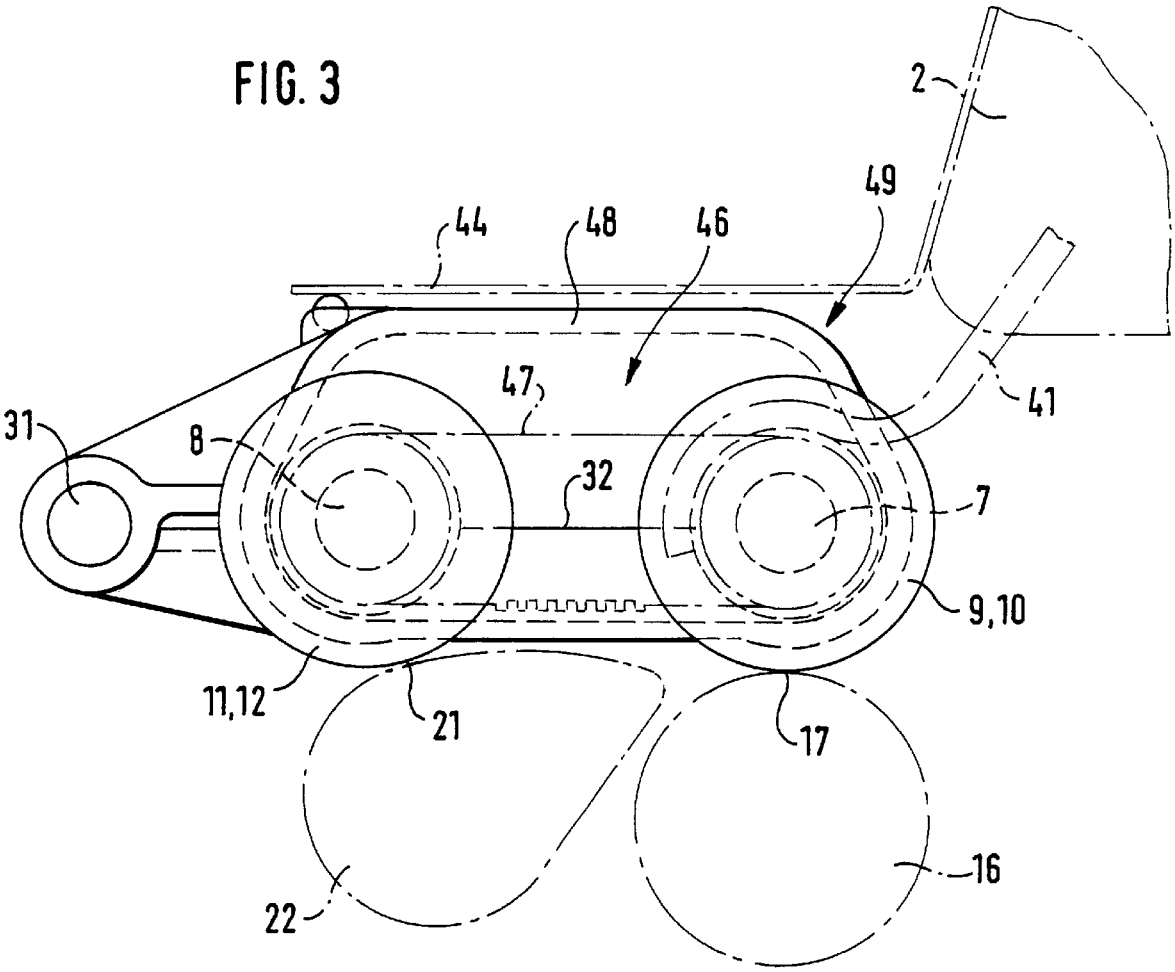
FIG. 3 is a view similar to FIG. 1 showing another embodiment of the present invention.

The embodiment according to FIG. 3 differs from the embodiment according to FIGS. 1 and 2 essentially only in that in place of the previous intermediate gear 40, another intermediate gear 46 is provided which comprises a toothed belt drive 47. The two-part housing 48 can be designed smaller, so that an overall lower-built top roller unit 49 is created.

The intermediate gear 46 according to FIG. 3 is also sealed off against fiber fly by the housing 48 and the toothed belt drive 47 again acts against the rotatable axles 7 and 8 of the double top rollers 5 and 6 which take the form of fixed rollers.

The remaining components correspond to the embodiment described above, so that a repeat description is unnecessary.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A top roller unit for a top weighting arm for a drafting apparatus of a spinning machine, which top roller unit comprises a holding device and two double top rollers, which each comprise two top rollers respectively arranged on a common rotatable axle, whereby in a transport direction of fiber strands being drafted in use, the first top rollers border a drafting zone for the fiber strands, and the second top rollers border a condensing zone arranged downstream of the drafting zone, and whereby the second top rollers are driven via a drive by the first top rollers, wherein the drive includes an intermediate gear drive which is common to all the top rollers of the top roller unit, and wherein both the double top rollers are fixedly arranged on the respective rotatable axles.

2. A top roller unit according to claim 1, wherein the intermediate gear drive comprises a toothed belt drive.

3. A top roller unit according to claim 2, wherein, in transport direction of the fiber strands, the first double top roller of the top roller unit is nested with its axle in a spring-mounted take-up of the top weighting arm.

4. A top roller unit according to claim 3, wherein the spring-mounted take-up comprises a loading spring for the first double top roller.

5. A top roller unit according to claim 4, wherein, in transport direction of the fiber strand, a loading spring of its own, arranged on the top weighting arm, is placed to the second double top roller.

6. A top roller unit according to claim 1, wherein, in transport direction of the fiber strands, the first double top roller of the top roller unit is nested with its axle in a spring-mounted take-up of the top weighting arm.

7. A top roller unit according to claim 6, wherein the spring-mounted take-up comprises a loading spring for the first double top roller.

8. A top roller unit for a top weighting arm for a drafting apparatus of a spinning machine, which top roller unit comprises a holding device and two double top rollers, which each comprise two top rollers respectively arranged on a common rotatable axle, whereby in a transport direction of fiber strands being drafted in use, the first top rollers border a drafting zone for the fiber strands, and the second top rollers border a condensing zone arranged downstream of the drafting zone, and whereby the second top rollers are driven via a drive by the first top rollers, wherein the drive includes an intermediate gear drive which is common to all the top rollers of the top roller unit, and wherein both the double top rollers are fixedly arranged on the respective rotatable axles, and comprising a holding device with a housing encapsulating the intermediate gear drive, through which housing the axles of the double top roller are guided through in a sealed way.

9. A top roller unit according to claim 8, wherein the housing consists of two section housings which can be swivelled to join together.

10. A top roller unit according to claim 9, wherein the intermediate gear drive comprises a toothed belt drive.

11. A top roller unit according to claim 9, wherein the intermediate gear drive comprises three toothed wheels, of which a respective toothed wheel is arranged on the axles of the double top roller and the third toothed wheel is a transfer wheel which bridges the distance between the two other toothed wheels.

12. A top roller unit according to claim 9, wherein, in transport direction of the fiber strands, the first double top roller of the top roller unit is nested with its axle in a spring-mounted take-up of the top weighting arm.

13. A top roller unit according to claim 12, wherein the spring-mounted take-up comprises a loading spring for the first double top roller.

14. A top roller unit according to claim 13, wherein, in transport direction of the fiber strand, a loading spring of its own, arranged on the top weighting arm, is placed to the second double top roller.

15. A top roller unit according to claim 8, wherein the intermediate gear drive comprises a toothed belt drive.

16. A top roller unit according to claim 8, wherein the intermediate gear drive comprises three toothed wheels of which a respective toothed wheel is arranged on the axles of the double top roller and the third toothed wheel is a transfer wheel which bridges the distance between the two other toothed wheels.

17. A top roller unit according to claim 8, wherein, in transport direction of the fiber strands, the first double top roller of the top roller unit is nested with its axle in a spring-mounted take-up of the top weighting arm.

18. A top roller unit according to claim 17, wherein the spring-mounted take-up comprises a loading spring for the first double top roller.

19. A top roller unit according to claim 18, wherein, in transport direction of the fiber strand, a loading spring of its own, arranged on the top weighting arm, is placed to the second double top roller.

20. A top roller unit for a top weighting arm for a drafting apparatus of a spinning machine, which top roller unit comprises a holding device and two double top rollers, which each comprise two top rollers respectively arranged on a common rotatable axle, whereby in a transport direction of fiber strands being drafted in use, the first top rollers border a drafting zone for the fiber strands, and the second top rollers border a condensing zone arranged downstream of the drafting zone, and whereby the second top rollers are driven via a drive by the first top rollers, wherein the drive includes an intermediate gear drive which is common to all the top rollers of the top roller unit, and wherein both the double top rollers are fixedly arranged on the respective rotatable axles, and wherein the intermediate gear drive comprises three toothed wheels, of which a respective toothed wheel is arranged on the axles of the double top roller and the third toothed wheel is a transfer wheel which bridges the distance between the two other toothed wheels.

21. A top roller unit according to claim 20, wherein, in transport direction of the fiber strands, the first double top roller of the top roller unit is nested with its axle in a spring-mounted take-up of the top weighting arm.

22. A top roller unit according to claim 21, wherein the spring-mounted take-up comprises a loading spring for the first double top roller.

23. A top roller unit according to claim 22, wherein, in transport direction of the fiber strand, a loading spring of its own, arranged on the top weighting arm, is placed to the second double top roller.

24. A top roller unit for a top weighting arm for a drafting apparatus of a spinning machine, which top roller unit comprises a holding device and two double top rollers, which each comprise two top rollers respectively arranged on a common rotatable axle, whereby in a transport direction of fiber strands being drafted in use, the first top rollers border a drafting zone for the fiber strands, and the second top rollers border a condensing zone arranged downstream of the drafting zone, and whereby the second top rollers are driven via a drive by the first top rollers, wherein the drive includes an intermediate gear drive which is common to all the top rollers of the top roller unit, and wherein both the double top rollers are fixedly arranged on the respective rotatable axles, wherein, in transport direction of the fiber strands, the first double top roller of the top roller unit is nested with its axle in a spring-mounted take-up of the top weighting arm, wherein the spring-mounted take-up comprises a loading spring for the first double top roller, and wherein, in transport direction of the fiber strand, a loading spring of its own, arranged on the top weighting arm, is placed to the second double top roller.

25. An assembly for a spinning machine, comprising:

sliver drafting rollers rotatably fixed to a first shaft and operable in use to form a downstream end of a drafting zone for respective adjacent spinning stations, said first and second drafting rollers being spaced axially from one another along the first shaft, forming a first intermediate space between facing ends of the first and second drafting rollers, first and second nipping rollers rotatably fixed to a second shaft and operable in use to form downstream ends of respective condensing zones disposed downstream of the respective drafting zones, said first and second nipping rollers being spaced from one another along the second shaft, forming a second intermediate space between facing ends of the first and second nipping rollers, an intermediate drive disposed to drivingly engage said first and second shafts at locations in the respective first and second intermediate spaces, and a holding device operable to support the intermediate drive and the first and second shafts and associated rollers.

26. An assembly according to claim 25, wherein the intermediate drive is a gear drive.

27. An assembly according to claim 26, wherein the intermediate gear drive comprises three toothed wheels, of which a respective toothed wheel is arranged on the axles of the double top roller and the third toothed wheel is a transfer wheel which bridges the distance between the two other toothed wheels.

28. An assembly according to claim 25, wherein the intermediate drive comprises a toothed belt drive.

29. An assembly according to claim 25, comprising a housing encapsulating the intermediate drive to thereby seal the intermediate drive against fiber fly.

30. A sliver processing assembly for a spinning machine, comprising:

an intermediate drive which in use drivingly connects a first pair of rollers at a downstream end of a drafting zone with a second pair of rollers at a downstream end of a condensing zone disposed downstream of the drafting zone, and a housing encapsulating the intermediate drive to thereby seal the intermediate drive against fiber fly.

31. An assembly according to claim 30, wherein said first pair rollers are rotatably fixed to a first rotatable axle, wherein said second pair of rollers are rotatably fixed to a second rotatable axle, and wherein said intermediate drive drivingly connects the first and second axles.

32. An assembly according to claim 31, wherein said first and second axle are guided through the housing in a sealed manner.

33. An assembly according to claim 32, wherein the housing consists of two section housings which can be swivelled to join together.

34. An assembly according to claim 30, wherein the housing consists of two section housings which can be swivelled to join together.

35. A top roller unit for a top weighting arm for a drafting apparatus of a spinning machine, which top roller unit comprises a holding device and two double top rollers, which each comprise two top rollers respectively arranged on a common axle, whereby in a transport direction of fiber strands being drafted in use, the first top rollers border a drafting zone for the fiber strands, and the second top rollers border a condensing zone arranged downstream of the drafting zone, and whereby the second top rollers are driven via a drive by the first top rollers, wherein the drive includes an intermediate drive which is common to all the top rollers of the top roller unit, and wherein both the double top rollers are fixedly arranged on the respective rotatable axles, wherein, in transport direction of the fiber strands, the first double top roller of the top roller unit is nested with its axle in a spring-mounted take-up of the top weighting arm, wherein the spring-mounted take-up comprises a loading spring for the first double top roller, and wherein, in transport direction of the fiber strand, a loading spring of its own, arranged on the top weighting arm, is placed to the second double top roller.

* * * * *

UNITED STATES PATENT AND TRADEMARK OFFICE

CERTIFICATE OF CORRECTION

PATENT NO. : 6,434,923 B2
DATED : August 20, 2002
INVENTOR(S) : Hans Stahlecker

It is certified that error appears in the above-identified patent and that said Letters Patent is hereby corrected as shown below:

Title page,
Item [73], Assignee, replace "Wilhelm Stanlecker GmbH" with -- Wilhelm Stahlecker GmbH --

Signed and Sealed this

Seventeenth Day of June, 2003

JAMES E. ROGAN
*Director of the United States Patent and Trademark Office*